US006389648B1

(12) United States Patent
Steinert et al.

(10) Patent No.: US 6,389,648 B1
(45) Date of Patent: May 21, 2002

(54) DEVICE AND METHOD FOR LENGTHENING A FREE SLIVER END IN A COILER CAN

(75) Inventors: Thomas Steinert, Kempen; Josef Temburg, Jüchen, both of (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 09/751,384

(22) Filed: Jan. 2, 2001

Related U.S. Application Data

(63) Continuation of application No. 09/632,790, filed on Aug. 4, 2000.

(30) Foreign Application Priority Data

Aug. 4, 1999 (DE) ..... 199 36 703

(51) Int. Cl.[7] ..... D04H 11/00

(52) U.S. Cl. ..... 19/159 A; 19/150; 19/157; 19/159 R

(58) Field of Search ..... 19/65 A, 150, 19/157, 159 A, 159 R, 236, 237, 238, 258, 260; 57/90, 265, 268, 276, 281

(56) References Cited

U.S. PATENT DOCUMENTS

| | | | | |
|---|---|---|---|---|
| 4,499,707 A | | 2/1985 | Desjobert et al. | |
| 5,414,901 A | * | 5/1995 | Sramek | 19/159 A |
| 5,566,425 A | * | 10/1996 | Mohr et al. | 19/159 A |
| 5,581,849 A | * | 12/1996 | Kriegler et al. | 19/159 A |
| 5,621,948 A | * | 4/1997 | Hartung | 19/150 |
| 5,647,097 A | * | 7/1997 | Kriegler et al. | 19/157 |
| 5,651,165 A | * | 7/1997 | Mohr et al. | 19/159 R |

FOREIGN PATENT DOCUMENTS

| | | |
|---|---|---|
| CH | 666 244 | 7/1988 |
| DE | 30 08 839 | 9/1980 |
| DE | 34 09 825 | 10/1985 |
| DE | 36 33 428 | 4/1988 |
| DE | 41 07 309 | 10/1991 |
| DE | 43 33 731 | 4/1994 |
| DE | 43 24 948 | 1/1995 |
| DE | 44 16 911 | 11/1995 |
| DE | 295 20 834 | 6/1996 |
| DE | 195 48 232 | 9/1996 |
| DE | 195 47 405 | 6/1997 |
| EP | 0 069 087 | 1/1983 |
| EP | 0 333 970 | 9/1989 |
| EP | 0 427 044 | 5/1991 |
| GB | 1015240 | 12/1965 |
| GB | 2 207 445 | 2/1989 |
| GB | 2 248 458 | 4/1992 |

* cited by examiner

*Primary Examiner*—John J. Clavert
*Assistant Examiner*—Gary L. Welch
(74) *Attorney, Agent, or Firm*—Venable; Gabor J. Kelemen

(57) ABSTRACT

An apparatus for lengthening, to a determined extent, a free sliver end portion hanging on an exterior face and from an upper edge of a can containing sliver deposited in coils, includes a device for grasping and firmly holding the free sliver end portion; and an arrangement for moving the grasping device and the can away from one another for pulling an additional length of sliver from the can to lengthen the free sliver end portion.

13 Claims, 4 Drawing Sheets

DEVICE AND METHOD FOR LENGTHENING A FREE SLIVER END IN A COILER CAN

CROSS REFERENCE TO RELATED APPLICATION

This application is a continuation of U.S. patent application Ser. No. 09/632,790 filed Aug. 4, 2000.

This application claims the priority of German Application No. 199 36 703.5 filed Aug. 4, 1999, which is incorporated herein by reference.

BACKGROUND OF THE INVENTION

This invention relates to a device for depositing sliver into a coiler can, particularly a flat coiler can having an elongated horizontal cross-sectional shape. Further, the invention concerns in particular a coiler can used in conjunction with a draw frame or a carding machine, wherein the sliver is deposited into the coiler can in coils and the free sliver end hangs from an upper can edge in a downward orientation at the outside of the coiler can.

In practice, the sliver is advanced in a sliver guiding channel of a rotary coiler head and fills, in coil layers, a coiler can which is positioned underneath the coiler head. During the filling operation the flat coiler can is horizontally reciprocated. When the coiler can is full, it is moved a predetermined distance from a zone underneath the coiler head. During this occurrence the sliver is still connected to the coiler head and extends to the uppermost coil layer in the coiler can. Subsequently the sliver is severed, for example, by means of a mechanical severing device. In this manner, a free sliver end is obtained which, because of the significant distance between the coiler can and the coiler head, has an appreciable length as it hangs down along the outside of the coiler can. In such a process first the final length of the free sliver end is obtained and subsequently the sliver is severed.

It is a disadvantage of the above-outlined conventional arrangement that an accurate length of the free sliver end cannot always be obtained. It may happen that the overhanging sliver end is excessively long for the subsequent processing during which the sliver end has to be accurately grasped to ensure that it is securely advanced to a processing apparatus. Further, the exact positioning and orientation with respect to the coiler can in case of a long sliver end is not ensured.

German patent document No. 195 48 232 to which corresponds U.S. Pat. No. 5,621,948 discloses an apparatus wherein the draft of a draw frame situated upstream of the sliver outlet opening is briefly increased such that a reduced cross section at a location of the sliver bundle is obtained. The combined sliver subsequently produced from the sliver bundle runs, with the reduced cross-sectional location, through the entire sliver channel of the coiler head up to the outlet opening. When the location of reduced thickness has reached the deflecting edge at the outlet of the sliver channel, the sliver is severed by virtue of the fact that the coiler can is moved away horizontally. Stated differently, the distance between the sliver outlet opening and the uppermost coiler layer in the coiler can is increased such that the sliver ruptures at the location of reduced thickness without the need of an additional severing device. Upon initiating the sliver severing process, one of the narrow walls of the flat coiler can is situated approximately below the severing edge. If the middle of the flat can were positioned below the severing edge, then upon moving the can away, additional deposited sliver coils would be dragged along which would be an undesired occurrence. In particular, the sliver end would be situated on top of the uppermost coil layer of the sliver rather than hanging laterally outside the coiler can. When the location of reduced thickness in the sliver is situated on the deflecting edge and the narrow wall of the coiler can is positioned below the deflecting edge, the coiler can is moved away, resulting in an excessively short free sliver end at the coiler can. A short sliver end is not adapted for being automatically grasped and admitted to the feeding device of an after-connected processing machine, for example, a spinning machine.

SUMMARY OF THE INVENTION

It is an object of the invention to provide an improved device and method of the above-outlined type from which the discussed disadvantages are eliminated and which, in particular, is capable of producing, in a simple manner, a free sliver end with a sufficient and accurately predetermined length.

This object and others to become apparent as the specification progresses, are accomplished by the invention, according to which, briefly stated, the apparatus for lengthening, to a determined extent, a free sliver end portion hanging on an exterior face and from an upper edge of a can containing sliver deposited in coils, includes a device for grasping and firmly holding the free sliver end portion, and an arrangement for moving the grasping device and the can away from one another for pulling an additional length of sliver from the can to lengthen the free sliver end portion.

Thus, first the sliver is severed between the coiler can and the outlet opening of the coiler head and subsequently, according to the invention, the precise, predetermined length of the sliver end is produced. According to the invention, between the end of the hanging sliver and the coiler can a defined relative motion is obtained. In particular, the sliver end is fixed and subsequently, the coiler can is horizontally shifted. Thus, the end portion of the sliver is lengthened by the removal and linear orientation of a sliver coil from the uppermost sliver layer of the sliver deposited in the coiler can. In this manner, a free sliver end with an accurately predeterminable length is obtained. Further, the position of the sliver may be precisely determined in relation to the can wall on which it hangs, so that in this manner too, a further processing of the sliver is improved. By virtue of the exact length and position of the free sliver end an automatic start of the successive machine is feasible.

The invention has the following additional advantageous features:

- Upon severance of the sliver the distance between the outlet end of a coiler head which deposits the sliver into the can in coils and a can wall closest to the coiler head is about 30 to 90 mm.
- After severing the sliver, the extended length of the free sliver end portion corresponds essentially to the distance between the can wall closest to the coiler head and the sliver outlet opening of the coiler head.
- The period during which the free sliver end portion is firmly held is determined by the control device of the sliver producing machine at which the sliver is deposited by the coiler head.
- The extended free sliver end portion has a length of about 90–140 mm, preferably between about 120–130 mm.
- The device which grasps and firmly holds the free sliver end portion is a mechanical clamping element.

DESCRIPTION OF THE PREFERRED EMBODIMENTS

Figure 1:
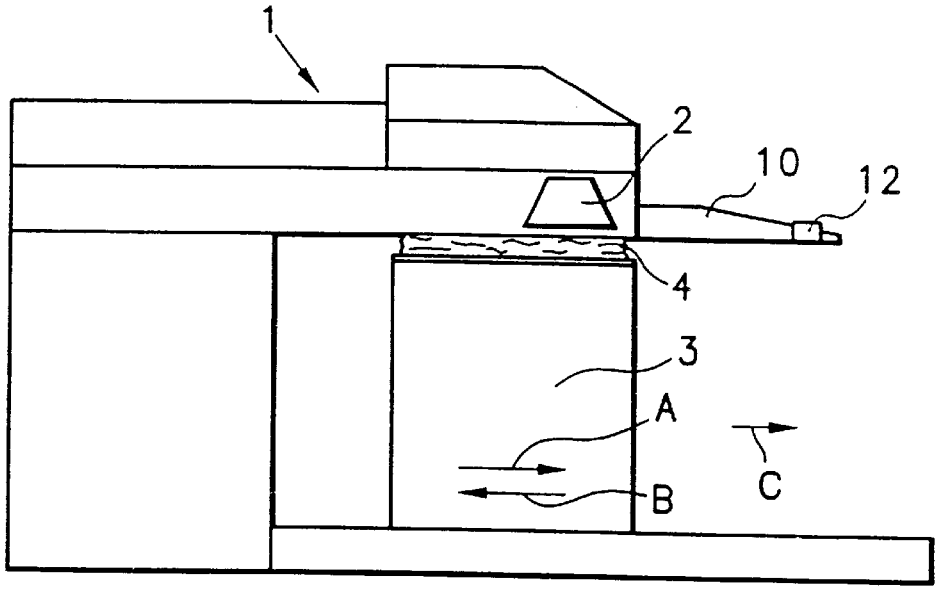
FIG. 1 is a schematic side elevational view of a draw frame and a reciprocated flat coiler can filled with sliver.

FIG. 1 illustrates a regulated, high-performance draw frame 1 which may be an HSR 1000 Model manufactured by Trützschler GmbH & Co. KG, Mönchengladbach, Germany. The slivers enter the draw unit of the draw frame from non-illustrated coiler cans, and after a drawing operation the plurality of slivers are combined into a single sliver which subsequently passes through a rotary coiler head 2. The latter deposits the sliver in coils into a flat coiler can 3 which is reciprocated in the direction of arrows A and B. The coiler can has an elongated, generally rectangular horizontal cross-sectional shape; in FIG. 1 one of the two opposite large sides of the coiler can 3 is visible. The coiler can 3, after being filled with the sliver 4, is moved out from under the coiler head 2 in the direction of the arrow C. During this occurrence the sliver is severed at a location thereof, and the sliver end of the coiled sliver contained in the coiler can 3 hangs loosely over the edge of one of the narrow end faces of the coiler can 3. A cover plate 10 extends over the top of the sliver fill as the coiler can 3 moves away in the direction of the arrow C; the cover plate 10 adjoins a carrier plate 11 as shown in FIG. 3A.

Figure 2:
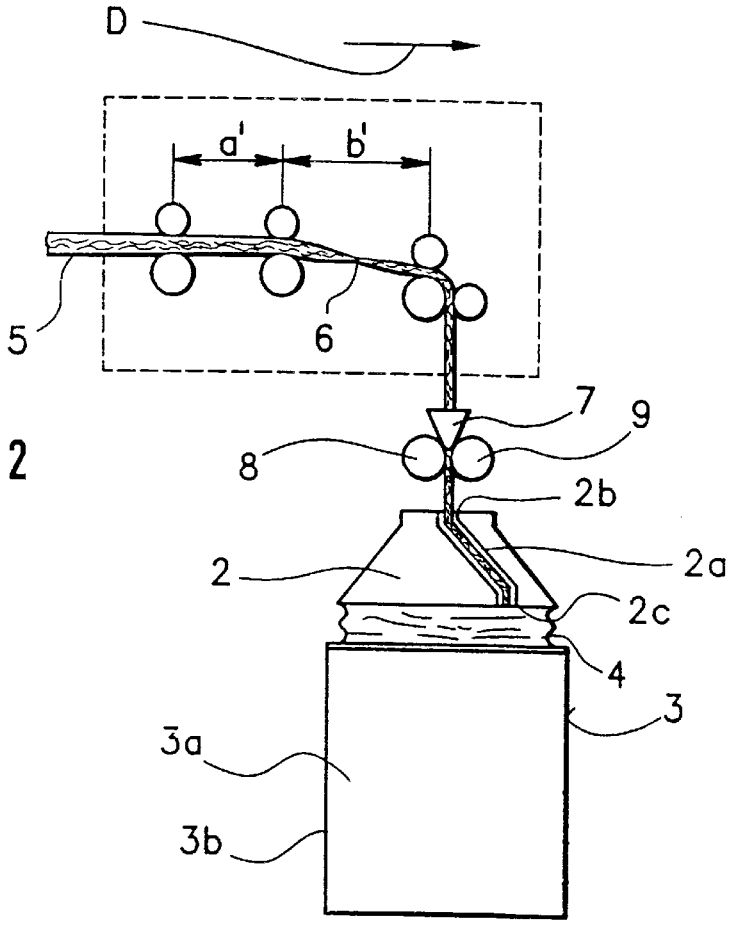
FIG. 2 is a schematic side elevational view illustrating the passage of the sliver through the draw unit and showing a location of reduced sliver thickness.

In FIG. 2 a 4-over-3 draw unit is shown, having a preliminary drawing field a' and a principal drawing field b'. The slivers 5 run through the draw unit in the direction of the arrow D. The sliver has a thinned (cross-sectionally reduced) location 6 which is obtained by a short-period speed increase of the output rolls of the draw unit. The slivers 5 enter a sliver trumpet 7 from which a combined sliver is pulled off by delivery rolls 8, 9. The sliver subsequently passes through a sliver channel 2*a* of the coiler head 2 from the sliver inlet opening 2*b* to the sliver outlet opening 2*c* and is thereafter deposited into the coiler can 3 which is horizontally reciprocated underneath the coiler head 2.

Figure 3A:
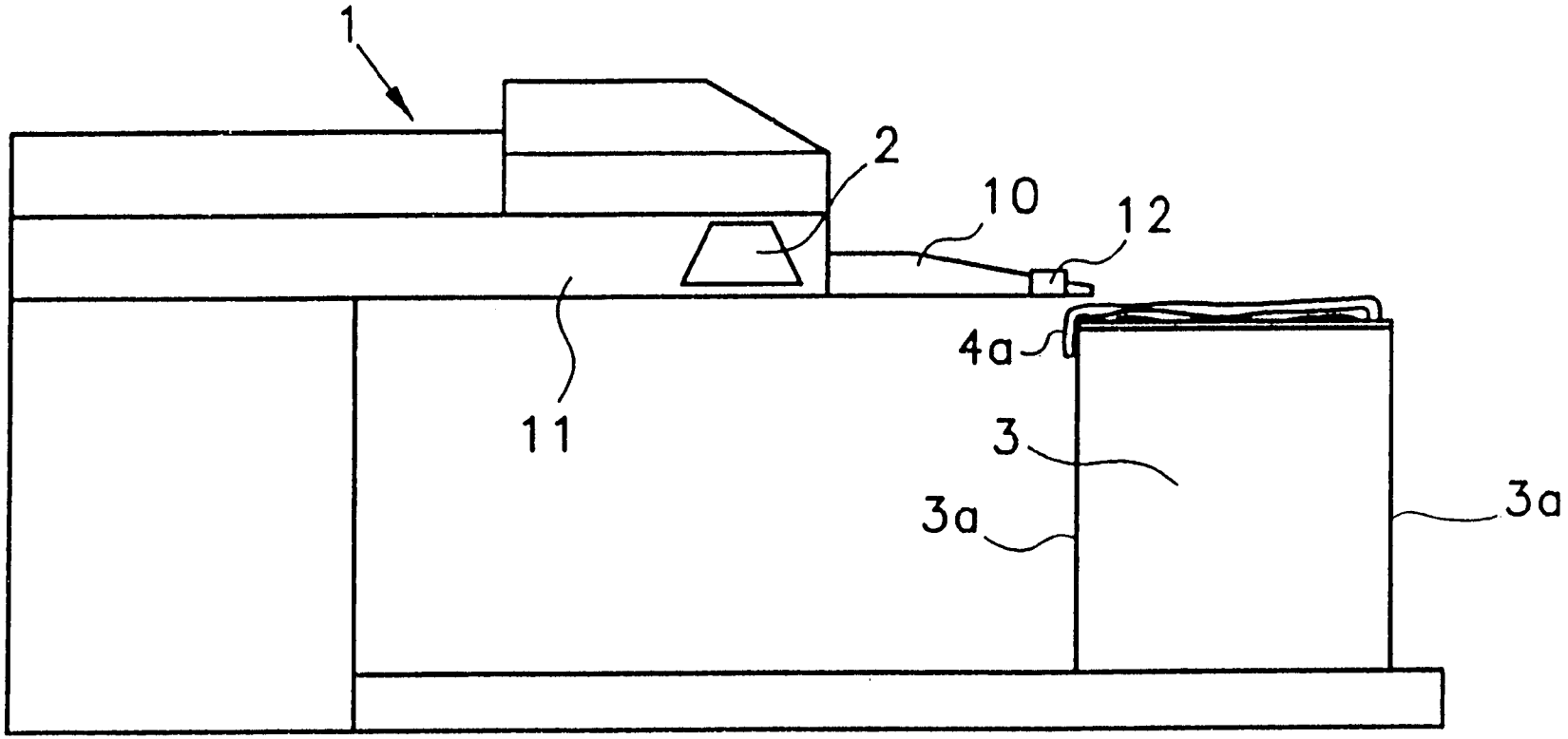
FIGS. 3A–3D are schematic side elevational views showing consecutive operational phases in lengthening a short sliver end.
Figure 3B:
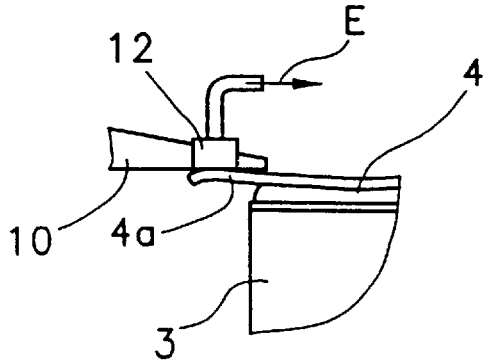
Figure 3C:
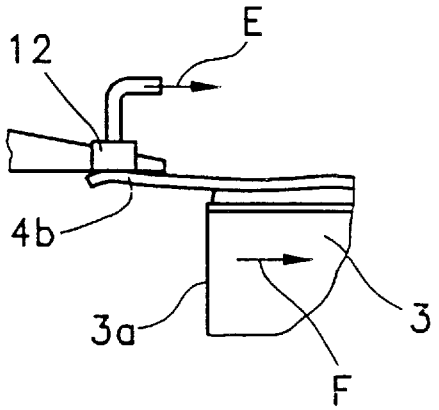
Figure 3D:
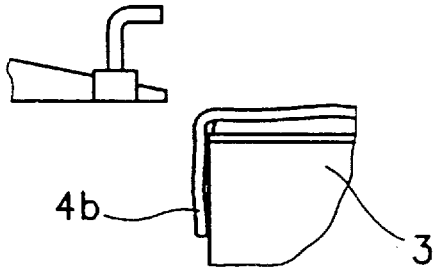

As shown in FIG. 3A, the filled coiler 3 is pushed out of the draw frame 1 in such a manner that one of the two narrow end walls 3*a* is situated approximately underneath the free end of the cover plate 10. The short (approximately 40 mm) sliver end 4*a* hangs downwardly from the upper edge of the can wall 3*a*. In the region of the free end of the cover plate 10 a pneumatic suction device 12 is arranged which is shown in more detail in FIG. 5. Upon turning on a suction stream E as shown in FIG. 3B, the short band end 4*a* is drawn upwardly against the cover plate 10 and is firmly held there by the force of the suction stream E. Thereafter, the coiler can 3 is, as shown in FIG. 3C, further shifted in the direction of the arrow F whereby a lengthened band end 4*b* is obtained. Subsequently, the suction stream E is turned off so that the lengthened band end 4*b* drops down from the suction device 12 and remains hanging on the end wall 3*a* by gravity.

Figure 4:
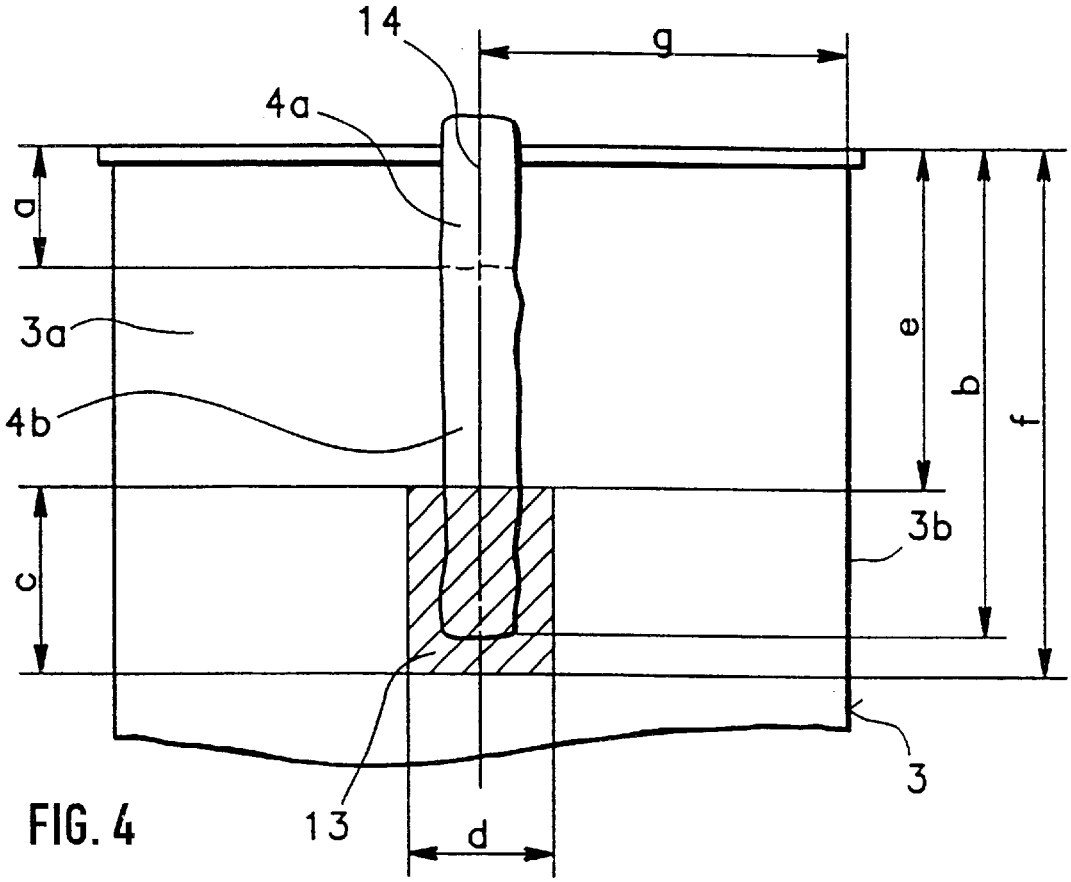
FIG. 4 is a fragmentary front elevational view of a rectangular, flat coiler can (one of the two narrow faces thereof being visible), illustrating a short and a lengthened sliver end.

In FIG. 4 the short sliver end 4*a* (whose terminal edge is shown in broken lines) and the lengthened sliver end 4*b* (whose terminal edge is shown in solid lines) are illustrated. The short sliver end 4*a* has a length a which extends from the upper edge of the can wall 3*a* to the free edge of the short sliver end. The lengthened sliver end 4*b* has a length b of, for example, 125 mm, extending from the upper edge of the wall 3*a* to the free sliver edge (shown in solid lines). The lengthened free sliver end 4*b* is situated in a generally rectangular "tolerance window" 13 which has a length c of approximately 50 mm and a width d of approximately 30 mm. The upper edge of the can wall 3*a* has a distance e of approximately 90 mm from the upper boundary and a distance f of approximately 140 mm from lower boundary of the tolerance window 13. The center line 14 of the coiler can wall 3*a* and that of the tolerance window 13 coincide. The distance g of the center line 14 from the large (wide) can wall 3*b* is approximately 60 mm.

Figure 5:
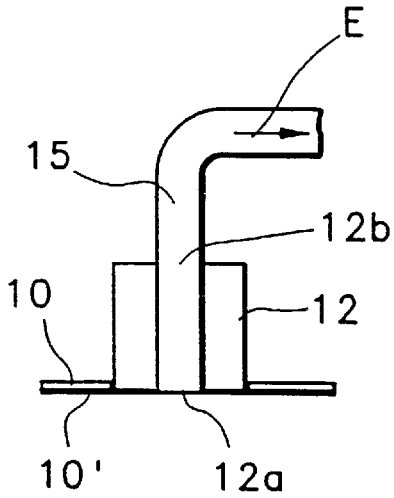
FIG. 5 is a schematic side elevational view of a pneumatic suction device operating as a sliver hold-down element.

The suction device 12 shown in FIGS. 1, 3A and 5 has a suction channel 12*b* provided at its end with a suction opening 12*a* which is flush with the lower surface 10' of the cover plate 10. The other end of the suction channel 12*b* is coupled to a suction conduit 15 which leads to a non-illustrated vacuum source which, in turn, is energized or de-energized by an electronic control device, also not illustrated. In FIG. 5 the direction of the vacuum stream flow is designated at E.

Reverting to FIG. 4, the lengthened sliver end 4*b* of defined length b which is obtained according to the invention and which hangs down laterally on the outside of the full coiler can 3, has advantages both for a manual and for an automatic handling.

If the sliver is to be manually threaded into a successive processing machine, for example, a spinning machine, locating and grasping the end 4*b* of the sliver is facilitated for the machine operator.

In case of an automated sliver insertion into the successive processing machine, the downwardly hanging sliver end 4*b* is even a precondition for an automatic operation. The recognition and the reproducible secure grasping of the sliver end 4*b* of the coiled fiber mass 4 without entraining additional coils therefrom is made possible in a simple manner. Therefore, in case of an automatic sliver insertion into a spinning machine a tolerance window is provided where the sliver end 4*b* must be located to ensure an operationally reliable functioning of the sliver insertion arrangement.

The invention may also be used for inserting slivers in creels for draw frames, flyers or air jet machines.

As a complementation of the sliver severing device the invention provides a device and a method for obtaining a sliver end of definite length hanging externally over an upper edge of the coiler can. A fixing, for example, clamping of the short sliver end 4*a* is effected preferably by the suction device 12 mounted on the fiber processing machine during a transporting motion in the direction of the arrow F of the full coiler can 3 in such a manner that the clamping element and the coiler can 3 are moved briefly away from one another as shown, for example, in FIG. 3C, whereby the short sliver end 4*a* is pulled out of the coiler can 3. The length b of the extended sliver end 4*b* which hangs loosely after being released, may be determined by setting the clamping period. For pulling out the short sliver end 4*a*, an already present motion process, such as the reciprocating motion of the coiler can 3, may be utilized. The clamping period has to be predetermined by the machine control to adapt the length b of the downwardly hanging extended sliver end 4*b* to the conditions prevailing in the successive fiber processing machine or to be able to obtain an extended sliver end 4*b* even in case of coiler cans which do not have an upwardly spring-urged movable bottom.

It is to be understood that for practicing the invention the coiler can may have a circular or square horizontal cross section. In such a case the shift of the can away from the coiler head is linear for a rectangular coiler can (as in case of a flat can) or at least approximately circular in case of a round can. In case the clamping element is a pneumatic suction device 12, the searching and clamping of the sliver end 4*a* may be performed in a simple manner.

The invention was described in connection with an example in which the clamping element is provided in the coiler cover of the processing machine, namely in the cover plate 10 of a flat can filling station of the high-performance draw frame HSR 1000. It is to be understood that the invention may be utilized in a similar manner by an apparatus which is independent from the sliver producing machine such as a draw frame.

It will be understood that the above description of the present invention is susceptible to various modifications, changes and adaptations, and the same are intended to be comprehended within the meaning and range of equivalents of the appended claims.

What is claimed is:

1. An apparatus for lengthening, to a determined extent, a free sliver end portion hanging on an exterior face and from an upper edge of a can containing sliver deposited in coils; the apparatus comprising (a) a device for grasping and firmly holding the free sliver end portion; and (b) means for moving said device and said can away from one another for pulling an additional length of sliver from the can to lengthen the free sliver end portion.

2. The apparatus as defined in claim 1, wherein said device comprises a pneumatic suction element.

3. The apparatus as defined in claim 1, wherein said device is stationarily supported.

4. A sliver producing apparatus comprising (a) an apparatus outlet from which sliver is discharged;

(b) a coiler can positioned below the apparatus outlet;

(c) a rotary coiler head positioned adjacent said apparatus outlet; the sliver passing from said apparatus outlet through said coiler head for being deposited in coils by said coiler head into said coiler can; and (d) an apparatus for lengthening, to a determined extent, a free sliver end portion hanging on an exterior face and from an upper edge of a can containing sliver deposited in coils; the apparatus comprising (1) a device for grasping and firmly holding the free sliver end portion; said device being mounted on the sliver producing apparatus; and (2) means for moving said device and said can away from one another for pulling an additional length of sliver from the can to lengthen the free sliver end portion.

5. The apparatus as defined in claim 4, further comprising a cover plate extending horizontally beyond said coiler head; said device being mounted on said cover plate.

6. The apparatus as defined in claim 4, wherein said means comprises means for moving said coiler can horizontally outward from underneath said coiler head.

7. A method of lengthening, to a determined extent, a free sliver end portion hanging on an exterior face and from an upper edge of a can containing sliver deposited in coils; comprising the following steps:.

(a) grasping and firmly holding the free sliver end portion by a device; and (b) moving said device and said can away from one another for pulling an additional length of sliver from the can to lengthen the free sliver end portion.

8. The method as defined in claim 7, wherein step (b) comprises the steps of stationarily holding said device and moving said can away from said device.

9. The method as defined in claim 7, wherein step (b) comprises the steps of stationarily holding said can and moving said device away from said can.

10. The method as defined in claim 7, further comprising the step of linearly orienting the free sliver end portion of extended length.

11. The method as defined in claim 7, further comprising the step of firmly holding said free sliver end portion for a predetermined period during the performance of step (b) for determining the length of extension of said free sliver end portion.

12. The method as defined in claim 7, comprising the step of performing step (b) for a predetermined period for determining the length of extension of said free sliver end portion.

13. The method as defined in claim 7, further comprising the steps of (a) depositing the sliver by a coiler head into the can;

(b) providing a weakened location in the sliver upstream of the coiler head as viewed in a running direction of the sliver into the coiler head;

(c) positioning the weakened location at an outlet of said coiler head; and (d) severing said sliver at said weakened location prior to starting said grasping and moving steps.

* * * * *